US005640659A

United States Patent [19]

Thompson et al.

[11] Patent Number: 5,640,659

[45] Date of Patent: Jun. 17, 1997

[54] DRY POWDER OR LIQUID TONER IMAGE TRANSFIXING SYSTEM

[75] Inventors: John A. Thompson; George B. Clifton, both of Boise; Carl D. Geleynse, Eagle, all of Id.

[73] Assignee: Hewlett-Packard Company, Palo Alto, Calif.

[21] Appl. No.: 544,052

[22] Filed: Oct. 17, 1995

[51] Int. Cl.[6] ..... G03G 15/14; G03G 15/20

[52] U.S. Cl. ..... 399/307; 399/302; 399/308; 430/126

[58] Field of Search ..... 355/279, 282, 355/286, 285, 312, 271, 280, 273, 256; 399/307, 302, 308, 237, 318, 297, 298; 430/126, 124

[56] References Cited

U.S. PATENT DOCUMENTS 5,530,533 6/1996 Wallace ..... 399/237
5,576,818 11/1996 Badesha et al. ..... 399/308

FOREIGN PATENT DOCUMENTS

WOA9200554 1/1992 WIPO .

*Primary Examiner*—Shuk Lee

[57] ABSTRACT

An imaging system carries an image defined by a dry powder or liquid toner. The imaging system includes a first transfer roll that electrostatically or adhesively accumulates the color image from a photoconductor, and a second transfer roll in transfixing contact with the first transfer roll. The second transfer roll possessing a central radiant heat source and a radiant heat source located adjacent to the first transfer roll in radiant proximity to an entering media sheet and the transfixing contact between the first and second transfer rolls. The first transfer roll includes at least a first basecoat layer and a topcoat layer. The basecoat layer includes a material that is electrically conductive and exhibits elastomeric and macrocompliant properties enabling the media to wrap through a significant arc under the transfixing contact and heat of the second transfer roll. The topcoat layer includes a specially formulated Fluorosilicone topcoat material that has a low surface energy and exhibits a microcompliance and resiliency enabling the first layer to compliantly mate with the photoconductor surface. The second transfer roll includes an outer, liquid carrier phobic layer and an inner compliant layer for enabling direct transfer of an image from the first transfer roll to a media sheet. The second transfer roll is optionally electrically biased with a polarity to prevent premature transfer of the image on the first transfer roll.

23 Claims, 1 Drawing Sheet

DRY POWDER OR LIQUID TONER IMAGE TRANSFIXING SYSTEM

FIELD OF THE INVENTION

This invention generally relates to electrophotography imaging systems, and more specifically to a system for one-step thermal transfixing and fusing of color images to a media using only a single electrostatic or adhesive transfer of the image.

BACKGROUND OF THE INVENTION

In electrophotography, a latent image is created on the surface of an insulating, photoconducting material by selectively exposing areas of the surface to light. A difference in electrostatic charge density is created between the areas on the surface exposed and unexposed to light. The visible image is developed by electrostatic toners containing pigment components dispersed in an insulating binder. Two types of developer materials are typically employed in the electrostatic imaging process. The first type of developer material is known as a dry developer material and comprises toner particles, or carrier granules having toner particles adhering tribo-electrically to the carrier granule. The second type of developer material is in the form of a liquid developer, comprising a liquid carrier having toner particles dispersed within the liquid carrier. The toners are selectively attracted to the photoconductor surface areas either exposed or unexposed to light, depending on the relative electrostatic charges of the photoconductor surface, development electrode and the toner. The photoconductor may be either positively or negatively charged, and the toner system similarly may contain negatively or positively charged particles. For laser printers, the preferred embodiment is that the photoconductor and toner have the same type, but different levels of charge.

A sheet of paper or intermediate transfer medium is given an electrostatic charge opposite that of the toner and passed close to the photoconductor surface, pulling the toner from the photoconductor surface onto the paper or intermediate medium still in the pattern of the image developed from the photoconductor surface. Thermal energy may also be used to assist transfer of the image to paper or intermediate transfer medium. For the case where no thermal transfer is used, a set of fuser rollers melts and fixes the toner in the paper subsequent to direct transfer or indirect transfer when using an intermediate transfer medium, producing the printed image.

There is a demand in the laser printer industry for multi-colored images. In color electrophotography, four color planes have to be constructed and accumulated either on the photoconductor, on an intermediate roller/drum or on the media. In liquid color, electrophotography storage on an intermediate has been the preferred approach. In dry powder, color electrophotography all techniques exist in the art.

With liquid toners, it has been discovered, the basic printing colors of yellow, magenta, cyan and black, may be applied sequentially to a photoconductor surface, and from there to a sheet of paper or intermediate medium to produce a multi-colored image. Liquid carriers used with liquid toners have characteristically exhibited high volatility. Such a highly volatile carrier liquid is easily evaporated by heat, pressure and/or air flow, thereby assuring a dry media sheet upon completion of the printing process. Such volatile carriers are flammable and consequently are impacted by today's strict regulations regarding the handling of flammable materials.

In dry powder, color electrophotography there are electrophotographic engines which store the four color planes on the photoconductor, on an intermediate or on paper. All of these devices use electrostatic transfer of the four color planes to the media followed by a fusing step. A key disadvantage of these systems is the requirement for independent fusing stations and/or complex media separation techniques. Another major disadvantage is the toner charge alteration which occurs during electrostatic transfer over the environmental range due to air breakdown and concomitant toner resolution loss that occurs with a second electrostatic transfer.

A single electrostatic transfer system represents an advantage by providing economy in terms of printing supplies, improved image resolution and, in the case of liquid toner, eliminating environmental and health concerns from disposal of excess liquid carrier medium.

SUMMARY OF THE INVENTION

It is an object of the invention to provide an improved color electrophotography system employing a single electrostatic or adhesive transfer of the toner-defined image.

It is another object of this invention to provide a color electrophotography system wherein complete image transfer is assured between a toner-defined photoconductive surface and any topology media sheet.

It is an object of the invention to provide an improved color electrophotography system employing a first transfer roll that has a unique topcoat layer allowing compliant mating with the photoconductor and electrostatic accumulation of the color image from the photoconductor and complete image transfer to a media sheet.

The electrostatic imaging system includes a photoconductor for carrying an image defined by a dry powder or liquid toner. The imaging system further includes a first transfer roll that electrostatically or adhesively accumulates the color image from the photoconductor, and a second transfer roll in transfixing contact with the first transfer roll. The second transfer roll possesses a central radiant heat source. A second independent radiant heat source is located adjacent to the first transfer roll in radiant proximity and positioned just prior to the transfixing contact between the first and second transfer rolls. The first transfer roll includes at least a first basecoat layer and a second superposed topcoat layer, the basecoat layer comprised of a material that is electrically conductive and which exhibits elastomeric and macro-compliant properties which enables the media to wrap through a significant arc under the transfixing contact and heat of the second transfer roll. Macrocompliance for the basecoat is defined here to mean sufficiently elastic to conform to surface dimensional variations of millimeters. The topcoat layer is comprised of a specially formulated Fluorosilicone topcoat material that has a low surface energy and exhibits a micro compliance and resiliency that enables the first layer to compliantly mate with the photoconductor surface. Microcompliance for the topcoat layer is defined here to mean sufficiently elastic to conform to surface dimensional variations of micrometers.

The second transfer roll comprises an outer, liquid carrier phobic layer for enabling direct transfer of an image from the first transfer roll to a media sheet. The second transfer roll is further electrically biased with a polarity to prevent premature transfer of the four color planes residing on the first transfer roll.

Additional objects, advantages and novel features of the invention will be set forth in part in the description that follows, and in part will become apparent to those skilled in the art upon examination of the following or may be learned by practice of the invention. The objects and advantages of the invention may be realized and attained by means of the instrumentalities and combinations particularly pointed out in the appended claims.

DETAILED DESCRIPTION OF THE INVENTION

Figure 1:
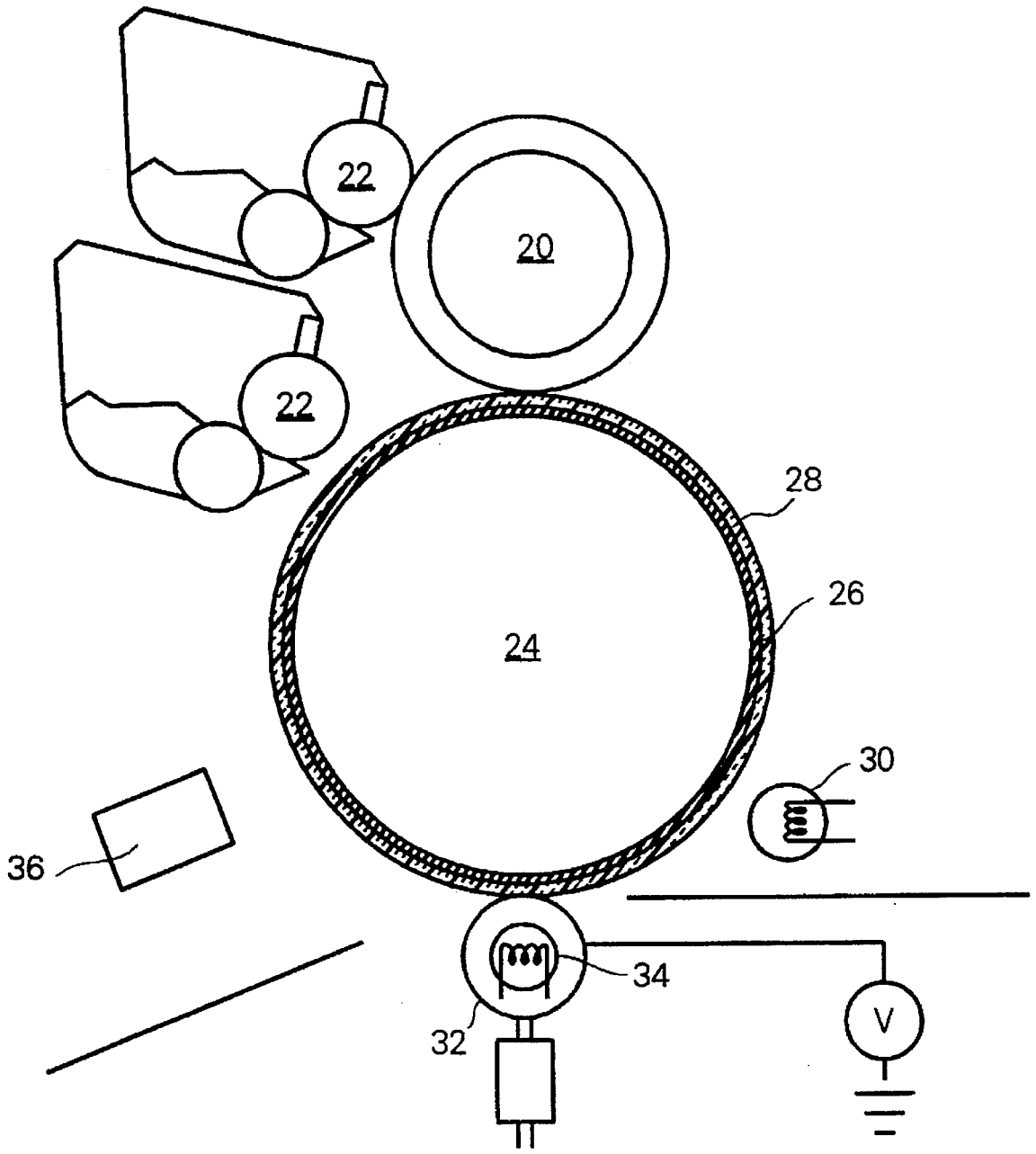
FIG. 1 is a schematic drawing of a color electrophotography system that incorporates the present invention.

Turning now to the figure, a laser beam applies an image charge state, in the known manner, to photoconductor 20. In accordance with known charge management procedures, either a discharge area development or a charge area development procedure may be employed.

A printer controller (not shown) selectively controls a laser beam to apply image wise signals to photoconductor 20 that are consistent with stored color plane images. In the known manner, a first color plane is accessed and controls laser beam to apply image signals in accordance with the color plane's pixel data. After such exposure, drum 22 rotates the imaged areas into juxtaposition with a color developer module containing a toner whose color matches the color of the color plane. That color developer module is then brought into engagement with the surface of photoconductor 20 and causes a toning of the imaged area. The means for moving each color developer module into and out of engagement with photoconductor surface are omitted as they are known in the art.

Each color plane is developed onto photoconductor 20 and, in the case of dry developer, immediately electrostatically transferred to first transfer roll (FTR) 24. With the use of liquid developer, each color plane is developed onto photoconductor 20 and immediately adhesively transferred to FTR 24. After all four color planes reside on FTR 24, paper is fed from the paper supply. A radiant heat source 30, here a 750 watt lamp, is turned on just prior to the paper arriving at the transfixing point. Lamp 30 is positioned such that radiant heat impinges onto the toner residing on FTR 24 as well as the entering paper or media sheet. This preheating of both the toner and the paper surface aids the thermal transfer and fusing of the image to occur once paper and toner contact under pressure and heat from second transfer roller (STR) 32. The preheating minimizes sensitivity to media type by heating the interfacing surfaces. Without preheating the transfixing can only be achieved by transferring sufficient heat through the thickness of the media. Consequently, for thick and/or thermally resistant medias greatly different STR 32 temperatures are required to correctly achieve the desired degree of fixing. The preheating permits the use of a single temperature to cover a large range of media.

Second transfer roller 32 (STR) is in transfixing contact with FTR 24 with the paper sandwiched between FTR 24 and STR 32. The transfixing contact is accomplished here by loading STR 32 against FTR 24 using a positional biasing load cylinder. STR 32 has a central radiant heat source 34, here a 250 watt radiant lamp, and is optionally electrically biased with a polarity to prevent premature transfer of the four color planes from FTR 24 to STR 32 prior to their transfixing contact. This configuration is particularly useful in conjunction with dry developer. The properties of FTR 24, which will be described in greater detail elsewhere in this description, cause the paper to wrap through a significant arc under the transfixing pressure and heat of STR 32. In addition STR 32 must be of a diameter of less than half the diameter of FTR 24. This results in a "natural" separation of the paper from the FTR 24. A final step is FTR cooling means 36. To prevent overheating of photoconductor 20, the heat added at the transfixing point must be removed from FTR 24 surface. Cooling means 36 is positioned adjacent to FTR 24 in a media sheet exiting region relative to the transfixing contact between FTR 24 and STR 32. Any of the cooling means known in the art will work with this system.

FTR 24 consists of three layers—an aluminum shell or core, electrically conductive, silicone rubber basecoat layer 26 and specially formulated fluorosilicone topcoat layer 28.

Basecoat layer 26 of FTR 24 is a unique carbon loaded, silicone rubber with a resistivity of $<10^8$ ohm/cm (such as Mobay 48V750). This relatively high electrical conductivity is necessary for achievement of electrostatic transfer of the toner from photoconductor 20 to FTR 24 for dry developer technology. This silicone rubber is formulated to have a hardness of 40 to 45 shore A, providing elastomeric properties and the macrocompliance to cause the wrapping arc and separation of the paper after transfixing of the image to the paper. This results in a "natural" separation of the paper from FTR 24.

Fluorosilicone topcoat layer 28 of FTR 24 has unique microcompliance properties which force contact of FTR 24 surface with even very rough paper topology. This results in transfer of the softened toner image uniformly to smooth and rough media alike. Fluorosilicone topcoat layer 28 is also unique in that it has a low surface energy which reduces further with the addition of heat resulting in release of 100% of the softened toner. This provides 100% transfer efficiency which is not possible with electrostatic transfer. The reverse biasing of STR 32 prevents premature toner transfer and is unique to a thermal transfer approach and is also impossible with the traditional electrostatic transfer approaches.

The newly synthesized, fluorosilicone rubber topcoat 28 of FTR 24 allows both dry and liquid toner transfer to a wide range of media, including widely used inexpensive rough surface papers, without image degradation. The formulation is as follows:

| | |
|---|---|
| Fluorosilicone polymer | 44.15% |
| Water | 0.43% |
| Me, Si(2NH) - filler treating agent (in situ) | 0.67% |
| Silica filler (400 $m^2$/gram surface area/mass) | 6.05% |
| Oxime Crosslinker | 11.35% |
| methyl ethyl ketone (MEK) solvent | 37.35% |

This unique formulation results in a soft (33 shore A) but tough and solvent resistant Fluorosilicone (FSi) rubber. The extreme softness provides the micro-compliance necessary for transfer to rough paper topologies. The fluorine content provides low surface energy for release of tacky polymers toners. Excessive crosslinker completely polymerizes the FSi to provide an extremely stable rubber. In addition, the filler additive is methylated to chemically bond the silica particles to the FSi polymer chains while providing the necessary structural integrity and, thereby, further increasing the stability of the formulation. This FSi polymer also exhibits the ability to adhesively transfer liquid toned images.

The pigments that are to be used with this imaging system are well known. For instance, carbon blacks such as channel black, furnace black or lamp black may be employed in the preparation of black developers. One particularly preferred carbon black is "Mogul L" from Cabot. Organic pigments, such as Phthalocyanine Blue (C.I.No. 74 160), Phthalocyanine Green (C.I.No. 74 260 or 42 040), Sky Blue (C.I.No. 42 780), Rhodamine (C.I.No. 45 170), Malachite Green (C.I.No. 42 000), Methyl Violet (C.I.No. 42 535), Peacock Blue (C.I.No. 42 090), Naphthol Green B (C.I.No. 10 020), Naphthol Green Y (C.I.No. 10 006), Naphthol Yellow S (C.I.No 10 316), Permanent Red 4R (C.I.No. 12 370), Brilliant Fast Pink (C.I.No. 15 865 or 16 105), Hansa Yellow (C.I.No. 11 725), Benzidine Yellow (C.I.No. 21 100), Lithol Red (C.I.No. 15 630), Lake Red D (C.I.No. 15 500), Brilliant Carmine 6B (C.I.No. 15 850), Permanent Red F5R (C.I.No. 12 335) and Pigment Pink 3B (C.I.No. 16 015), are also suitable. Inorganic pigments, for example Berlin Blue (C.I.No. Pigment Blue 27), are also useful. Additionally, magnetic metal oxides such as iron oxide and iron oxide/magnetites may be mentioned.

As is known in the art, binders are used in liquid toner dispersions to fix the pigment particles to the desired support medium such as paper, plastic film, etc., and to aid in the pigment charge. These binders may comprise thermoplastic resins or polymers such as ethylene vinyl acetate (EVA) copolymers (Elvax® resins, DuPont), varied copolymers of ethylene and an a, b-ethylenically unsaturated acid including (meth)acrylic acid and lower alkyl ($C_1$–$C_5$) esters thereof. Copolymers of ethylene and polystyrene, and isostatic polypropylene (crystalline) may also be mentioned. Both natural and synthetic wax materials may also be used The binders are insoluble in the carrier liquid at room temperature.

It will therefore be understood that modifications and variations are possible without departing from the scope of the invention as expressed in the following claims.

What is claimed is:

1. A color electrophotography imaging system comprising:

a photoconductor for carrying an image constructed from a plurality of color toners;

a first transfer roll for electrostatically receiving the image constructed on the photoconductor, said first transfer roll having at least a basecoat layer and topcoat layer, the basecoat layer having an electrical resistivity of less than $10^8$ ohm/cm and a hardness of 40 to 45 shore A, the topcoat layer being solvent resistant and exhibiting a low surface energy and resilient microtopology;

a second transfer roll in transfixing contact with the first transfer roll and having a central radiant heat source and at least a single outer layer; and a radiant heat source located adjacent to the first transfer roll in radiant proximity to an entering media sheet and the transfixing contact between the first and second transfer rolls.

2. The apparatus of claim 1 wherein the basecoat layer of the first transfer roll comprises a carbon containing silicone rubber and the topcoat layer is a fluorosilicone.

3. The apparatus of claim 2 wherein the fluorosilicone topcoat layer has a composition comprising:

43.27 to 45.03% Fluorosilicone polymer 0.42 to 0.44% Water, 0.66 to 0.68% Me,Si(2NH), 5.93 to 6.17% Silica filler, 11.12 to 11.58% Oxime Crosslinker, 36.6 to 38.1% methly ethyl ketone (MEK) solvent.

4. The apparatus of claim 3 wherein the fluorosilicone topcoat layer exhibits a resiliency of 33 shore A.

5. The apparatus of claim 4 further comprising a first transfer roll cooling means located adjacent to the first transfer roll subsequent to the transfixing contact between the first and second transfer rolls.

6. The apparatus of claim 5 wherein said second transfer roll is electrically biased with a polarity repulsive to the electrostatically received image on the first transfer roll.

7. The apparatus of claim 2 wherein the fluorosilicone topcoat layer exhibits a resiliency of 33 shore A.

8. The apparatus of claim 3 further comprising a first transfer roll cooling means located adjacent to the first transfer roll in a media sheet exiting region relative to the transfixing contact between the first and second transfer rolls.

9. The apparatus of claim 2 further comprising a first transfer roll cooling means located adjacent to the first transfer roll in a media sheet exiting region relative to the transfixing contact between the first and second transfer rolls.

10. The apparatus of claim 1 further comprising a first transfer roll cooling means located adjacent to the first transfer roll in a media sheet exiting region relative to the transfixing contact between the first and second transfer rolls.

11. The apparatus of claim 4 wherein said second transfer roll is electrically biased with a polarity repulsive to the electrostatically received image on the first transfer roll.

12. The apparatus of claim 3 wherein said second transfer roll is electrically biased with a polarity repulsive to the electrostatically received image on the first transfer roll.

13. The apparatus of claim 2 wherein said second transfer roll is electrically biased with a polarity repulsive to the electrostatically received image on the first transfer roll.

14. The apparatus of claim 1 wherein said second transfer roll is electrically biased with a polarity repulsive to the electrostatically received image on the first transfer roll.

15. A color electrophotography imaging system comprising:

a photoconductor for carrying an image constructed from a plurality of color toners;

a first transfer roll for adhesively receiving the image constructed on the photoconductor, said first transfer roll having at least a basecoat layer and topcoat layer, the basecoat layer having an electrical resistivity of less than $10^8$ ohm/cm and a hardness of 40 to 45 shore A, the topcoat layer being solvent resistant and exhibiting a low surface energy and resilient microtopology;

a second transfer roll in transfixing contact with the first transfer roll and having a central radiant heat source and at least a single outer layer; and a radiant heat source located adjacent to the first transfer roll in radiant proximity to an entering media sheet and the transfixing contact between the first and second transfer rolls.

16. The apparatus of claim 15 wherein the basecoat layer of the first transfer roll comprises a carbon containing silicone rubber and the topcoat layer is a fluorosilicone.

17. The apparatus of claim 16 wherein the fluorosilicone topcoat layer has a composition comprising:

43.27 to 45.03% Fluorosilicone polymer, 0.42 to 0.44% Water, 0.66 to 0.68% Me,Si(2NH), 5.93 to 6.17% Silica filler, 11.12 to 11.58% Oxime Crosslinker, 36.6 to 38.1% methly ethyl ketone (MEK) solvent.

18. The apparatus of claim 17 wherein the fluorosilicone topcoat layer exhibits a resiliency of 33 shore A.

19. The apparatus of claim 18 further comprising a first transfer roll cooling means located adjacent to the first transfer roll in a media sheet exiting region relative to the transfixing contact between the first and second transfer rolls.

20. The apparatus of claim 16 wherein the fluorosilicone topcoat layer exhibits a resiliency of 33 shore A.

21. The apparatus of claim 17 further comprising a first transfer roll cooling means located adjacent to the first transfer roll in a media sheet exiting region relative to the transfixing contact between the first and second transfer rolls.

22. The apparatus of claim 16 further comprising a first transfer roll cooling means located adjacent to the first transfer roll in a media sheet exiting region relative to the transfixing contact between the first and second transfer rolls.

23. The apparatus of claim 15 further comprising a first transfer roll cooling means located adjacent to the first transfer roll in a media sheet exiting region relative to the transfixing contact between the first and second transfer rolls.

* * * * *